US009969516B2

(12) United States Patent
Zaporski et al.

(10) Patent No.: US 9,969,516 B2
(45) **Date of Patent: *May 15, 2018**

(54) PACKAGING INCLUDING POUCH FOR CONTAINER

(71) Applicant: General Mills, Inc., Minneapolis, MN (US)

(72) Inventors: Neil E Zaporski, Ramsey, MN (US); Anthony W Swenson, Blaine, MN (US)

(73) Assignee: General Mills, Inc., Minneapolis, MN (US)

( * ) Notice: Subject to any disclaimer, the term of this patent is extended or adjusted under 35 U.S.C. 154(b) by 941 days.

This patent is subject to a terminal disclaimer.

(21) Appl. No.: 14/086,404

(22) Filed: Nov. 21, 2013

(65) Prior Publication Data

US 2014/0079849 A1 Mar. 20, 2014

Related U.S. Application Data

(63) Continuation of application No. 13/051,378, filed on Mar. 18, 2011, now Pat. No. 8,591,976.

(51) Int. Cl.
*B65B 61/20* (2006.01)
*B65D 75/56* (2006.01)
(Continued)

(52) U.S. Cl.
CPC ..... *B65B 61/202* (2013.01); *B65D 75/563* (2013.01); *B65D 77/24* (2013.01); *B65D 81/3205* (2013.01); *B65D 2517/0056* (2013.01)

(58) Field of Classification Search
CPC ... B65B 61/202; B65B 61/14; B65D 81/3205; B65D 51/28; B65D 51/2814; B65D 51/2842; B65D 33/16; B65D 33/1608; B65D 77/24; B65D 33/14; B65D 33/06; B65D 75/563; B65D 2517/0056; A47G 19/2205
(Continued)

(56) References Cited

U.S. PATENT DOCUMENTS 2,250,666 A 7/1941 Godefroy
2,863,778 A 12/1958 Lynn
(Continued)

FOREIGN PATENT DOCUMENTS

WO WO 2008/131424 10/2008

*Primary Examiner* — Erik Kashnikow
*Assistant Examiner* — Ericson M Lachica
(74) *Attorney, Agent, or Firm* — Diederiks & Whitelaw, PLC; John L. Crimmins, Esq.

(57) ABSTRACT

A pouch, designed to be attached, either directly or indirectly, to a container, is provided with two end portions, each of which is formed with an elongated slit. When the pouch is directly attached atop a container, the end portions are pulled over the lid and catch a rim portion of the container. When the pouch is placed upon a lid covered container, the end portions of the pouch can catch or engage the lid. In accordance with an aspect of the invention, a pair of spaced slits extends from each elongated slit, thereby creating a tab or flap in each end portion. The flap is configured to either directly catch a rim of the container or be tucked under the lid, i.e., between the lid and the container, to attach the pouch to the lid and, indirectly, the container.

20 Claims, 7 Drawing Sheets

(51) Int. Cl.
*B65D 77/24* (2006.01)
*B65D 81/32* (2006.01)

(58) Field of Classification Search
USPC ..... 426/112, 115, 106, 120, 124; 53/410, 53/476, 138.1; 220/694, 23.83, 23.86, 220/703, 735, 732; 383/16, 9, 10, 200, 383/207, 208, 209, 94; 493/212, 226, 63, 493/82, 83, 86, 137, 194, 199; 206/223, 206/732, 217
See application file for complete search history.

(56) References Cited

U.S. PATENT DOCUMENTS 3,094,210 A 6/1963 Van Den Berg
3,344,734 A 10/1967 Aguirre-Batres et al.
4,584,101 A * 4/1986 Kataoka ..... B65D 85/8043 210/474
4,616,751 A 10/1986 Forbes, Jr.
4,635,291 A 1/1987 Barton
4,883,935 A 11/1989 Fairchild et al.
4,923,702 A 5/1990 Powell et al.
5,059,325 A 10/1991 Iida
D327,217 S * 6/1992 Wallace ..... D9/707
5,310,072 A 5/1994 Matusovsky et al.
5,674,546 A 10/1997 Barnes et al.
5,960,973 A 10/1999 Markson
6,065,871 A * 5/2000 Warr ..... B65D 33/08 383/10
6,296,137 B1 10/2001 Bjornsen
6,921,480 B2 7/2005 Post
6,971,521 B2 12/2005 Pinyot
8,104,959 B2 1/2012 Lucas et al.
8,172,103 B2 5/2012 Spyros et al.
8,591,976 B2 * 11/2013 Zaporski ..... B65B 61/202 206/216
2002/0144913 A1 10/2002 Falkenberg et al.
2005/0053313 A1 * 3/2005 Lucas ..... B65B 61/16 383/16
2005/0118309 A1 * 6/2005 Beckman ..... B65D 23/12 426/120
2005/0123657 A1 6/2005 Beckman
2005/0241964 A1 11/2005 Taylor
2006/0016719 A1 1/2006 Cassese et al.
2008/0099486 A1 5/2008 Becker-Wiemann

* cited by examiner

PACKAGING INCLUDING POUCH FOR CONTAINER

CROSS-REFERENCE TO RELATED APPLICATIONS

This application is a continuation of U.S. patent application Ser. No. 13/051,378 filed Mar. 18, 2011 entitled "Packaging Including Pouch for Container", pending. The entire contents of this application are incorporated herein by reference.

FIELD OF THE INVENTION

The invention pertains to the art of packaging and, more particularly, to a packaging arrangement wherein a pouch is configured to be conveniently and easily attached, either directly or indirectly, to a container.

BACKGROUND OF THE INVENTION

In connection with packaging certain food items intended to be consumed together, it can be desirable to maintain the food items separate until it is time to consume the food. The separation of the food items can be particularly important when the items are to be combined prior to consumption and one of the items has a high moisture content while the other item has a low moisture content. A common example would be cereal and milk wherein it may be highly desirable to maintain the crunchy characteristic of the cereal by not combining the cereal with the milk until just prior to consuming the cereal. In this example, the cereal and the milk are separately packaged and simply combined in a bowl or other container. In certain circumstances, an overall packaging can include two separately packaged food items which are meant to be combined prior to consumption, with the two packaged food items being attached to one another for ease of transport or sale of the overall packaging. A good example of such an overall packaging is fruit/yogurt parfaits, such as those sold in certain fast food chains, wherein granola is provided with the parfait in the overall packaging, but maintained separate until combined by the consumer right before consumption.

One known packaging arrangement of this type is illustrated in FIGS. 1 and 2. As shown, a packaging arrangement 2 includes a container or cup 5 adapted to house a first food item, a lid 7 for sealing container 5, and a pouch 9 housing a second food item which is meant to be mixed with the first food item prior to being consumed. For consumption purposes, packaging arrangement 2 also includes a utensil 12. More specifically, as shown, container 5 includes a base 18, as well as a sidewall 19 extending from base 18 and leading to an upper flared portion 20 having an associated annular rim 21. Lid 7 as shown includes a side wall 30 having a lower edge 31, and an upper ledge or top portion 33. Like many known lid and container arrangements, lid 7 is adapted to be attached to container 5 with lower edge 31 extending about annular rim 21 and side wall 30 snap-fittingly engaging rim 21. As depicted, lid 7 is integrally formed with a flange 45 projecting from lower edge 31, with flange 45 being provided with an enlarged opening 46.

As also shown in these figures, pouch 9 has a first sidewall 52 and a second sidewall 53 which are joined along side edge 55, side edge 56 and bottom edge 57, as well as a heat sealed region 60 having a top edge 61. Formed in heat sealed region 60, spaced from top edge 61, is a slit 63. In attaching pouch 9 to lid 7 and, indirectly, container 5, pouch 9 is positioned such that flange 45 projects through slit 63. More specifically, slit 63 of pouch 9 receives flange 45 and pouch 9 is moved beyond opening 46 so as to be directly adjacent side wall 30, thereby exposing opening 46 radially outward of pouch 9 as clearly shown in FIG. 2. In a final assembly stage, utensil 12 is slid into opening 46. More specifically, utensil 12 takes the form of a spoon including a handle 67 and a scoop portion 68. With this arrangement, handle 67 is pushed into opening 46, until scoop portion 68 reaches opening 46 in order to attach utensil 12 to lid 7 as shown in FIG. 2.

Although the above discussion certainly outlines one way in which two different items, particularly food items such as yogurt/parfait and granola, can be separately packaged and attached together, there are seen to be various drawbacks to this arrangement. For instance, forming the lid with the specialty flange is somewhat costly. In addition, assembling this known arrangement is considered to be particularly time consuming. Furthermore, this overall packaging is seen to be quite limited in its potential use. For at least these reasons, there is a need for a packaging arrangement for attaching a pouch to a container which will enable two items, such as a high moisture level food product and a low moisture level food product, to be individually packaged and then attached together in a manner which enables the items to be readily separated and, if desired, consumed together.

SUMMARY OF THE INVENTION

The invention is directed to the construction of a pouch, as well as a packaging arrangement wherein the pouch is configured to be conveniently and easily attached to a container. More specifically, the pouch is provided with two end portions, each of which is formed with an elongated slit from which extend a pair of spaced, substantially perpendicular slits, thereby creating a cantilevered tab or flap in each end portion. When the pouch is placed upon a lid-covered container so as to extend across an internal storage region of the container, the end portions of the pouch can be pulled over the lid and each flap tucked under the lid, i.e., between the lid and the container, to attach the pouch to the lid and, indirectly, the container. The pouch can also be attached directly to a container. In accordance with this aspect of the invention, the pouch still extends across the internal storage region of the container with the end portions of the pouch being pulled beyond a rim of the container, while each flap engages the rim to hold the pouch in place. Although employable to interconnect a wide variety of items together for storage, transport or the like, the invention is considered to be particularly advantageous in attaching a pouch housing a low moisture food product to a container storing a high moisture food product, thereby isolating the two food products and enabling the food products to be mixed just prior to consumption.

Additional objects, features and advantages of the invention will become more readily apparent from the following detailed description when taken in conjunction with the drawings wherein like reference numerals refer to corresponding parts in the several views.

DETAILED DESCRIPTION OF EMBODIMENTS

Figure 1:
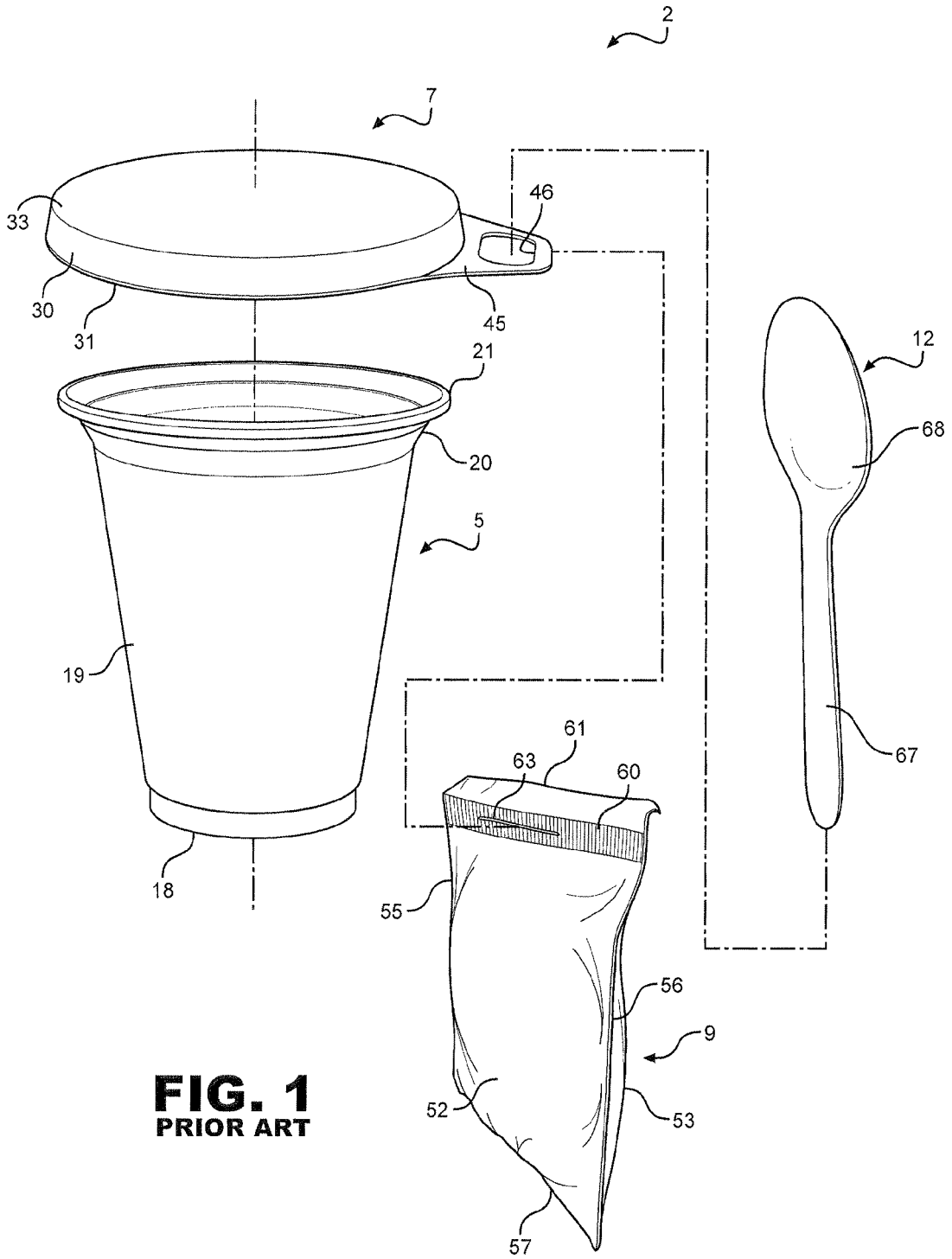
FIG. 1 PRIOR ART
FIG. 1 is an exploded view of a known packaging arrangement including separately contained food items which are attached to each other and intended to be mixed just before consumption.
Figure 2:
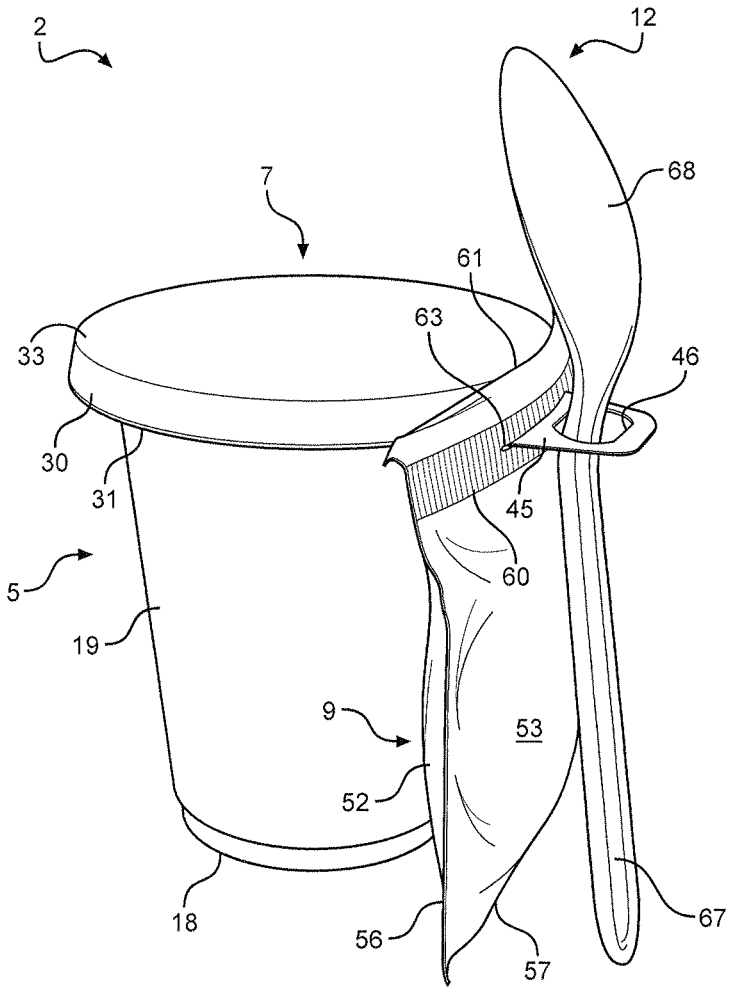
FIG. 2 PRIOR ART
FIG. 2 is a perspective view of the known packaging arrangement of FIG. 1 fully assembled.
Figure 3:
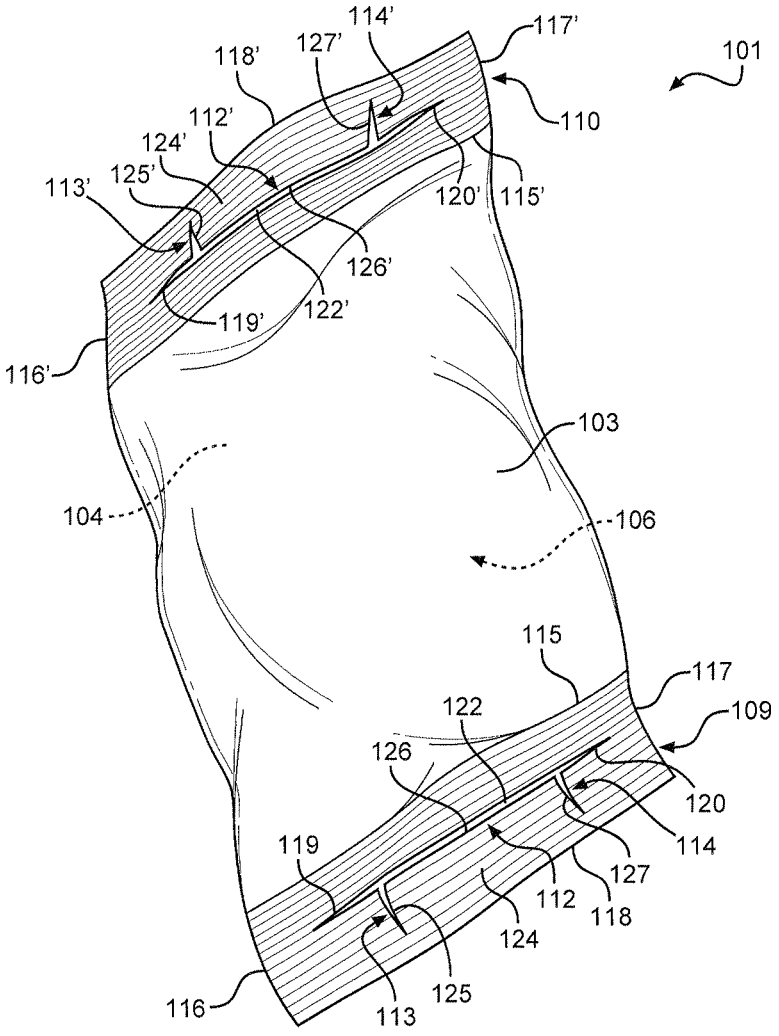
FIG. 3 is a perspective view of a pouch constructed in accordance with the invention.

With initial reference to FIG. 3, a pouch constructed in accordance with the present invention is generally indicated at 101. As shown, pouch 101 includes a first side wall 103 and a second side wall 104 defining an interior cavity 106 therebetween. First side wall 103 and second side wall 104 are preferably formed of a flexible plastic material and sealed to each other, such as by heat sealing, cold sealing, utilizing adhesive or any other means known in the art, along a first or lower sealed region 109 and a second or upper sealed region 110 in order to enclose interior cavity 106. At this point, it should be noted that interior cavity 106 can house a wide range of items, with one embodiment including a food product. As the overall structure associated with both upper and lower sealed regions 109 and 110 are the same, a detailed description will now be made of lower sealed region 109 and it should be readily understood that corresponding numbers indicated with primes in FIG. 3 for upper sealed region 110 refer to corresponding structure.

As depicted, lower sealed region 109 is provided with an elongated slit 112, as well as a pair of spaced slits 113 and 114 which extend substantially perpendicularly from elongated slit 112 in the embodiment shown. More specifically, lower sealed region 109 is defined by an inner edge 115, side edges 116 and 117, and an outer edge 118. Elongated slit 112 is provided in lower sealed region 109 within the confines of inner, side and outer edges 115-118. Therefore, elongated slit 112 has a first end portion 119 which is spaced from side edge 116, as well as a second end portion 120 which is spaced from side edge 117. As shown, elongated slit 112 has an intermediate portion 122 that is located closer to inner edge 115 than outer edge 118. With the inclusion of spaced slits 113 and 114 which extend from elongated slit 112 at positions between intermediate portion 122 and end portions 119 and 120 respectively, a cantilevered tab or flap 124 is defined in lower sealed region 109. As shown, flap 124 includes free edges 125, 126 and 127, with free edge 126 defining part of elongated slit 112 and being located closer to inner edge 115 than outer edge 118. Again, upper sealed region 110 has corresponding structure so as to define a flap 124' based on the inclusion of an elongated slit 112' and spaced slits 113' and 114'.

Figure 4:
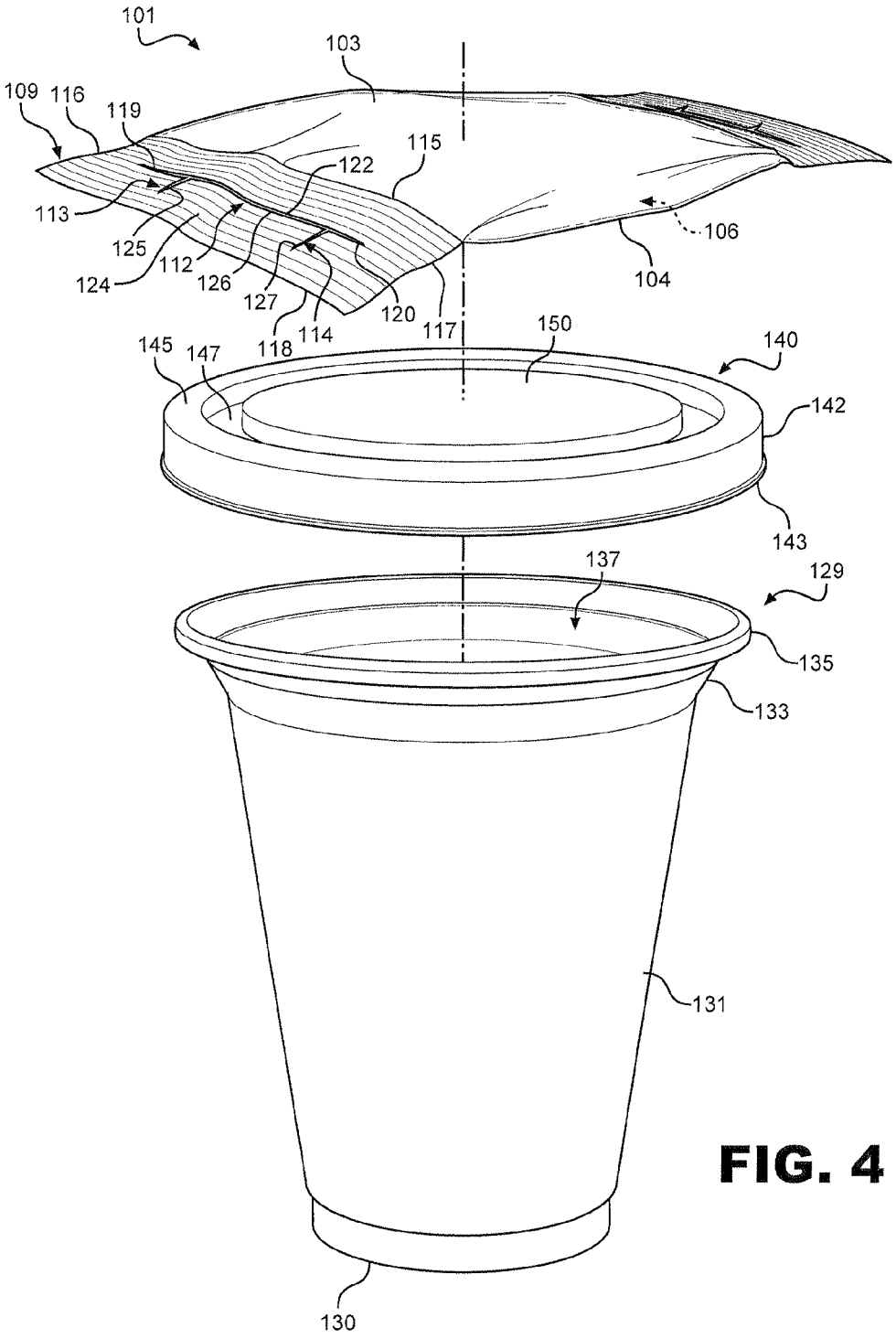
FIG. 4 is an exploded view of the pouch of FIG. 3 in combination with a container, as well as a lid for the container.

Reference will now be made to FIG. 4 in illustrating the manner in which pouch 101 is employed in connection with a combination container and lid based on the invention. As shown, there is provided a container in the form of a cup 129 having a base 130 and an annular, upstanding side portion or wall 131 which leads to an upper flared portion 133 and an annular rim 135. This overall arrangement establishes an internal storage region 137 within cup 129. Internal storage region 137 is adapted to house a distinct item, such as a second food item which can be selectively mixed with the food item within pouch 101 just prior to consumption. That is, it is desired to maintain the food item stored in pouch 101 separate from the food item in cup 129 until just prior to consumption as will be discussed more fully below. Associated with cup 129 is a lid 140 having a body portion defined, in part, by a side wall 142 that terminates in a peripheral lip 143. Side wall 142 leads to an upper ledge 145 that is shown to be located radially outwardly of a recessed annular region 147 and a central plateau portion 149. At this point, it should be recognized that the particular construction of cup 129 and lid 140 can greatly vary in accordance with the present invention. It is merely important in accordance with certain aspects of the invention that lid 140 have an associated side wall 142 which is adapted to extend about annular rim 135 and to be snapped or otherwise connected to cup 129 in order to close internal storage region 137. Certainly, there are various known cup and lid arrangements of this type commonly found in the market today, particularly thermoformed drinking cups, soft ice cream containers, yogurt/parfait containers and the like.

Figure 5:
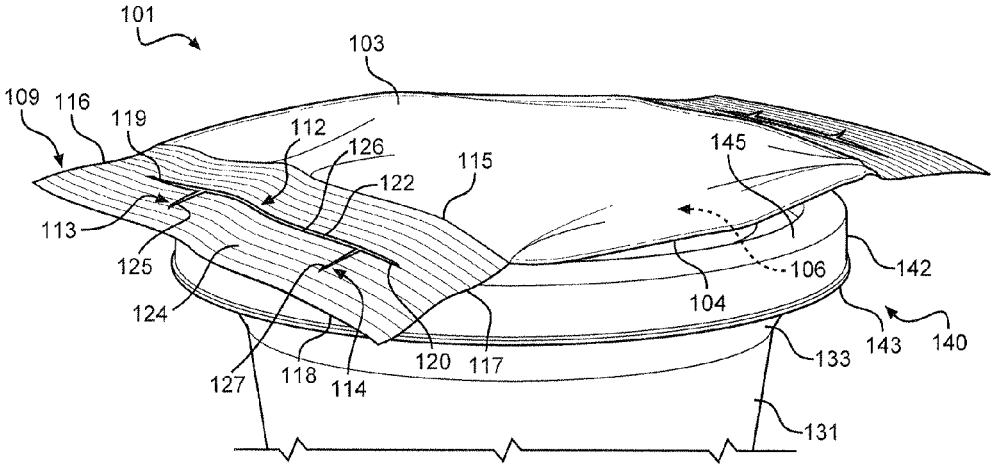
FIG. 5 is a perspective view of the packaging arrangement of the invention partially assembled, illustrating the lid of FIG. 4 attached to the container of FIG. 4, with the pouch shown resting atop the lid.

The particular construction of pouch 101 advantageously enables the same to be connected to cup 129 and lid 140 in a manner which does not require known cups and lids of this type to be varied in construction. To further explain this aspect of the invention, reference will be made to FIGS. 5-7. As shown in FIG. 5, pouch 101 rests upon lid 140 which, in turn, is attached to rim 135 of cup 129. Pouch 101 is sized such that sealed regions 109 and 110 extend beyond lid 140. Prior to this attachment sequence, it is assumed that internal storage region 137 of cup 129 has already been pre-filled with an item to be stored, and interior cavity 106 of pouch 101 also houses another item. Although various items could be stored in each of cup 129 and pouch 101, one particularly advantageous use of the present invention is to provide a high moisture content food item within internal storage region 137 of cup 129 and a rather low moisture level food item in interior cavity 106 of pouch 101. For instance, the high moisture food item could be a yogurt or parfait, while the low moisture food item is constituted by granola. In such an arrangement, it would be highly desirable to maintain the granola separately packaged and apart from the yogurt/parfait in order that the granola can maintain its crunchiness until just prior to consumption when the granola is mixed with the yogurt/parfait.

Figure 6:
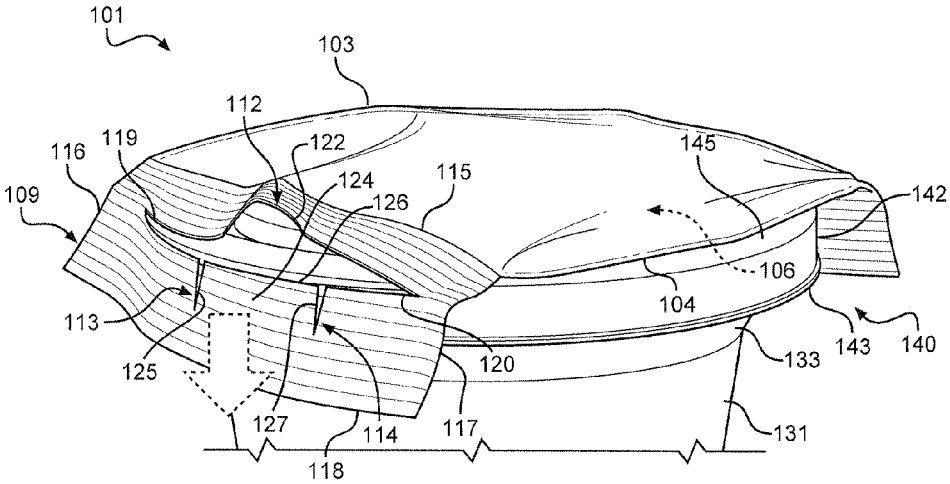
FIG. 6 is a perspective view, similar to that of FIG. 5, but with end portions of the pouch being partially pulled down about the lid.
Figure 7:
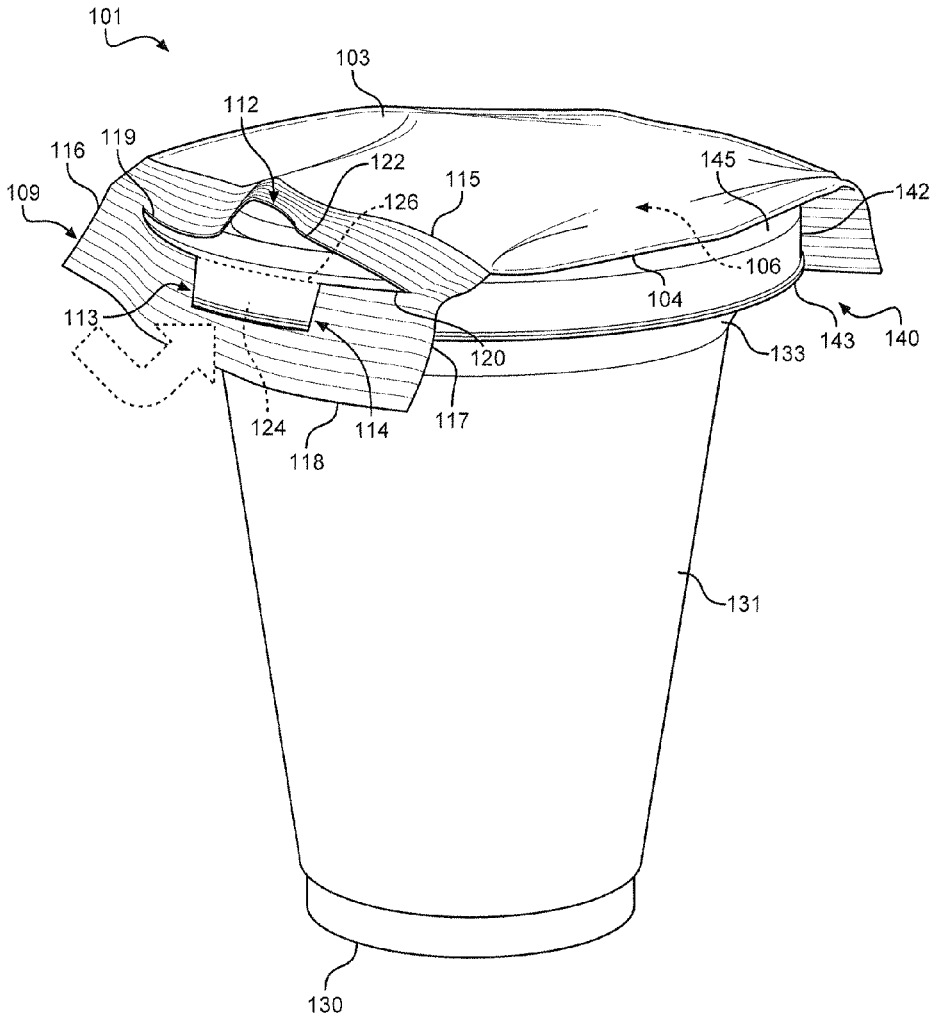
FIG. 7 is a perspective view, similar to that of FIG. 6, but with end portions of the pouch being fully pulled down about the lid and tab portions of the pouch extending between the lid and container.

Regardless of the particular items contained within pouch 101 and cup 129, FIG. 6 illustrates a second stage in connection with attaching pouch 101 to cup 129 and lid 140. As shown, each sealed region 109 and 110 is pulled downward around side wall 142 of lid 140 until a respective flap 124, 124' extends about lid 140 and below lip 143. At this time, each sealed region 109, 110 is slightly released with flap 124, 124' slipping between side wall 142 of lid 140 and cup 129 as clearly shown in FIG. 7. Preferably, this overall sequence is performed manually by a user simply grasping and pulling on sealed regions 109 and 110 while directing each flap 124, 124' behind side wall 142 of lid 140 to indirectly attach pouch 101 to cup 129. Certainly, a requisite amount of tension is placed on side walls 103 and 104 of pouch 101 during this process and, even when sealed regions 109 and 110 are released, side walls 103 and 104 still have some tension placed thereon, with the flaps 124 and 124' engaging the peripheral lip 143, as represented by the enlargement of elongated slit 112 in FIG. 7. With this arrangement, pouch 101 is firmly retained upon lid 140 until manually removed by again grasping at least one of sealed regions 109 and 110 to force a respective flap 124, 124' from behind side wall 142 of lid 140. Once pouch 101 is removed, lid 140 can be taken from atop cup 129 in a standard fashion and then, if desired, the contents of pouch 101 can be added to the contents of cup 129 prior to overall consumption. Otherwise, the contents of cup 129 and pouch 101 can be consumed separately, assuming each is used to store a food item.

Figure 8:
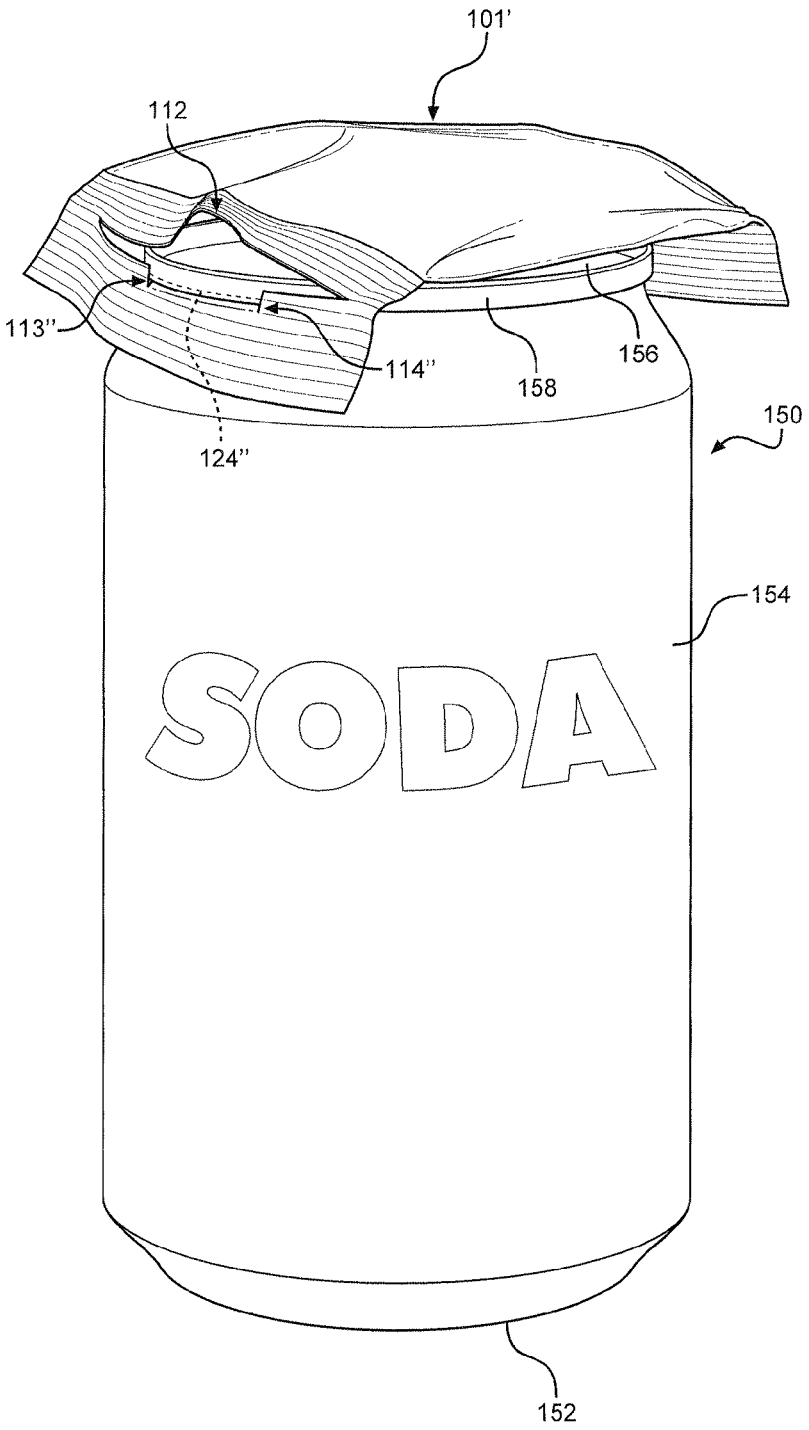
FIG. 8 is a perspective view illustrating a modified form of the pouch attached to a soda container.

At this point, it should be understood that pouch 101 could be directly attached to cup 129, or even various other containers. For instance, pouch 101 can be used with cup 129 without the presence of lid 140. In a manner corresponding to that set forth above, pouch 101 would extend across internal storage region 137 with a user grasping and pulling on sealed regions 109 and 110 until each flap 124, 124' engages rim 135. It has been found advantageous to reduce the length of slits 113, 114 and 113', 114' to further stiffen the flap when attaching pouch 101 directly to a container. FIG. 8 exemplifies this direct attachment aspect wherein a pouch 101', having elongated slit 112 and spaced slits 113" and 114" defining a flap or tab 124", is directly attached to a soft drink can 150. As depicted, can 150 takes a form widely known in the art, such as an aluminum can including a base 152, an upstanding annular side wall 154, a top 156 and a rim 158. For use in attaching pouch 101' to can 150, it is preferred to provide a stiffer flap 124" versus flaps 124 or 124'. For example, slits 113, 114 and 113', 114' can extend from a respective elongated slit 112, 112' approximately ¼ inches (about 0.6 cm) when pouch 101 is attached to a cup 129 having a lid 140, and ⅛ inches (about 0.3 cm) when attaching directly to cup 129 or can 150 in order to increase the rigidity or stiffness of flaps 124" for this embodiment. In any case, as clearly shown in this figure, pouch 101' is attached to can 150 by extending across an internal storage region (not labeled) located beneath top 156, with the opposing end regions of pouch 101' extending about can 150 and the opposing flaps 124" catching rim 158. In this embodiment, pouch 101' can house various items, including a wide range of snack items, such as peanuts, candy, cereal or the like, to be consumed with the soft drink in can 150. When employing the direct attachment arrangement, the container could certainly take other advantageous forms to aid the pouch in being directed attached thereto, such as being formed with an undercut or enlarged rim for enhanced engagement by the flaps of the pouch. Depending on the configuration of the container, the pouch could actually be formed with just the elongated slits for attachment to the container rim. In the embodiments employing a lid, assuming the lid was made fairly stiff, the pouch could even be pre-attached to the lid prior to attachment of the lid to the container.

Based on the above, it should be readily apparent that the construction of the pouch in accordance with the invention enables the pouch to be readily attached to a combination container and lid, or a container without a lid, in a simple and time efficient manner, and without the need for any custom lid configurations including flanges and the like. In addition, the construction enables the pouch to be attached to a wide range of existing containers, including cups, soda cans, vegetable or fruit cans, jars or the like. Certainly, it should be understood that the invention is not limited for use with round containers and lids as the pouch could also be attached to various polygonal shaped containers. Furthermore, although considerable attention has been paid to having food items in the pouch and/or container, this need not be the case. Instead, a wide variety of items could be stored and packaged together in accordance with the invention. Therefore, although described with reference to certain embodiments of the invention, it should be readily understood that various changes and/or modifications can be made to the invention without departing from the spirit thereof. In general, the invention is only intended to be limited by the scope of the following claims.

The invention claimed is:

1. A packaging assembly comprising:

a pouch formed from a flexible material, said pouch including opposing sidewall portions interconnected at opposing end regions and defining an interior cavity containing a food product, each of said end regions constituting a sealed region provided with an elongated slit and a pair of spaced slits extending from the elongated slit so as to establish a flap between the pair of spaced slits in each of said end regions; and a lid for closing an internal storage region of a container, said lid having a body portion and a peripheral lip, said pouch being positioned upon the lid, with the opposing end regions extending about the body portion and each flap projecting under the peripheral lip.

2. The packaging assembly according to claim 1, wherein each pair of spaced slits is fully contained within a respective said sealed region.

3. The packaging assembly according to claim 2, wherein each of the spaced slits extends from the elongated slit only in a direction away from the sealed region.

4. The packaging assembly according to claim 3, wherein spaced slits extend from the elongated slit at positions spaced from terminal ends of the elongated slit.

5. The packaging according to claim 4, wherein each said elongated slit includes opposing terminal ends which extend beyond a respective said flap.

6. The packaging assembly according to claim 1, wherein the food product is a crunchy, low moisture content food item.

7. The packaging assembly according to claim 6, wherein the food product is granola.

8. The packaging assembly according to claim 1, further comprising: a container including a base, a rim and an upstanding side portion extending between the base and the rim, said container including an internal storage region which is closed by the lid.

9. The packaging assembly according to claim 8, wherein each flap is positioned between the side wall portion of the container and the peripheral lip of the lid.

10. A pouch formed from a flexible material establishing opposing sidewall portions interconnected at opposing end regions and defining an interior storage cavity containing a food product, each of said end regions constituting a sealed region provided with an elongated slit having first and second terminal ends and a pair of spaced slits extending from the elongated slit at positions spaced from the first and second terminal ends of the elongated slit so as to establish a flap between the pair of spaced slits in each of said end regions, with the elongated slit extending beyond the flap.

11. The pouch according to claim 10, wherein each pair of spaced slits is fully contained within a respective said sealed region.

12. The pouch according to claim 10, wherein each of the spaced slits extends from the elongated slit in a direction away from the interior storage cavity.

13. The pouch according to claim 10, wherein the food product is a crunchy, low moisture content food item.

14. The pouch according to claim 10, wherein said flap is disposed on an opposite side of the elongated slit than the interior storage cavity.

15. The pouch according to claim 10, wherein each of the spaced slits extends substantially perpendicularly from the elongated slit.

16. The pouch according to claim 10, wherein the elongated slit includes an intermediate portion between the first and second terminal ends, and each of the spaced slits extends from the elongated slit between the intermediate portion and a respective one of the first and second terminal ends.

17. The pouch according to claim 10, wherein each of the spaced slits extends from the elongated slit only in a direction away from the sealed region.

18. A method of packaging items together comprising:

attaching a lid, having a body portion and a peripheral lip, to a container to close an internal storage region of the container with the peripheral lip extending about a rim of the container; and attaching a pouch, which is formed from a flexible material, includes opposing sidewall portions interconnected at opposing end regions with each of said end regions constituting a sealed region provided with an elongated slit, and defines an interior cavity containing a food product, to the container by extending the flexible pouch across the closed internal storage region of the container, with the opposing end regions of the pouch extending about and engaging the rim of the container, wherein the pouch further includes a pair of spaced slits extending from the elongated slit so as to establish a flap between the pair of spaced slits in each of said end regions, said pouch being attached to the container by positioning the pouch upon the lid, extending the opposing end regions about the body portion and positioning each flap such that each flap projects under the peripheral lip.

19. The method of claim 18, further comprising, in attaching the pouch to the container, pulling each opposing end region around the side wall portion until a respective said flap extends about the lid and below the peripheral lip, and then releasing the said opposing end region such that said flap slips between the side wall portion and the lid.

20. The method of claim 18, wherein attaching the pouch includes tensioning the opposing sidewall portions to extend the flexible pouch across the closed internal storage region, with some of the tension being maintained on the sidewall portions after fully attaching the pouch to the container.

* * * * *